US010925784B1

(12) United States Patent
Abuhamda

(10) Patent No.: US 10,925,784 B1
(45) Date of Patent: Feb. 23, 2021

(54) LIFTING PAD FOR WHEELCHAIR

(71) Applicant: Nasser Abuhamda, Brooklyn, NY (US)

(72) Inventor: Nasser Abuhamda, Brooklyn, NY (US)

( * ) Notice: Subject to any disclaimer, the term of this patent is extended or adjusted under 35 U.S.C. 154(b) by 0 days.

(21) Appl. No.: 16/448,286

(22) Filed: Jun. 21, 2019

(51) Int. Cl.
*A47C 31/11* (2006.01)
*A61G 5/10* (2006.01)
*A61G 5/12* (2006.01)

(52) U.S. Cl.
CPC ..... *A61G 5/1043* (2013.01); *A47C 31/11* (2013.01); *A61G 5/1045* (2016.11); *A61G 5/1048* (2016.11); *A61G 5/122* (2016.11)

(58) Field of Classification Search
CPC .... A61G 5/1043; A61G 5/122; A61G 5/1045; A61G 5/1048; A47C 31/11
USPC ..... 297/229, 219.1–228.13
See application file for complete search history.

(56) References Cited

U.S. PATENT DOCUMENTS 1,659,405 A * 2/1928 Love ..... A47C 7/425 297/229
1,927,331 A * 9/1933 Edward ..... A47C 7/425 297/229
1,934,615 A * 11/1933 Selverstone ..... A47C 31/11 297/229
2,218,951 A * 10/1940 Flaharty ..... B61C 17/04 297/228.12
2,734,556 A * 2/1956 Hebrank ..... A47C 7/021 297/230.1
3,140,897 A * 7/1964 Dougherty ..... A47C 20/027 297/229 X
3,336,610 A * 8/1967 Geddings ..... A47D 15/003 5/420
3,517,963 A * 6/1970 Woods ..... A47C 7/18 297/229 X
3,659,297 A * 5/1972 Schutz ..... A47D 5/006 5/655
3,700,282 A * 10/1972 Rowland ..... A47C 11/005 297/440.23
3,707,008 A * 12/1972 Fellin ..... B60N 2/2812 5/653
4,190,918 A * 3/1980 Harvell ..... A47C 4/52 297/219.1 X
4,459,714 A * 7/1984 Lin ..... A47C 27/081 24/581.12
4,500,102 A * 2/1985 Haury ..... A61G 5/00 297/229 X
4,597,605 A * 7/1986 Gilbert ..... A47O 7/425 297/229 X (Continued)

FOREIGN PATENT DOCUMENTS

JP 2003070844 A * 3/2003 ..... A61G 5/1091

*Primary Examiner* — Rodney B White
(74) *Attorney, Agent, or Firm* — Sanchelima & Associates, P.A.; Christian Sanchelima; Alexander J. Rodriguez

(57) ABSTRACT

A lifting pad to be used with a wheelchair in order to provide additional comfort to a user is disclosed herein. The lifting pad comprises a cover with a seat portion and a backrest portion. The lifting pad also comprises a first slot formed in the seat portion and a second slot formed in the backrest portion in order to receive inserts such as foam inserts which are to provide comfort to a user. The lifting pad further comprises at least one foam insert arranged inside each of the first slot and the second slot found on the cover. The lifting pad is adapted to be placed on a seat to provide support and comfort to a user seated thereon.

9 Claims, 4 Drawing Sheets

(56) References Cited

U.S. PATENT DOCUMENTS 4,629,246 A * 12/1986 Fulton ..... A61G 5/1043 5/653 X
4,630,863 A * 12/1986 Roberts ..... A47C 27/001 297/219.1
4,654,907 A * 4/1987 Haugaard ..... A45C 3/10 297/17
4,682,818 A * 7/1987 Morell ..... A47C 27/148 297/452.27
4,753,480 A * 6/1988 Morell ..... A47C 27/148 297/452.27
4,824,171 A * 4/1989 Hollingsworth ..... A47C 1/146 297/351
4,842,329 A * 6/1989 Owens ..... A47C 7/021 297/188.01
4,843,662 A * 7/1989 Handelman ..... A47C 7/021 5/653
4,925,241 A * 5/1990 Geraci ..... A47O 7/021 297/229 X
5,029,350 A * 7/1991 Edelson ..... A47C 15/004 297/229 X
5,056,533 A * 10/1991 Solano ..... A61G 5/1091 5/627
5,074,620 A * 12/1991 Jay ..... A61G 5/0891 297/337
5,088,747 A * 2/1992 Morrison ..... A61G 5/1043 297/219.1
5,123,699 A * 6/1992 Warburton ..... A61G 5/1043 297/219.1
5,190,350 A * 3/1993 Hwang ..... A47C 1/143 297/226
5,297,848 A * 3/1994 Grinnell ..... A47C 7/029 297/219.1
5,384,923 A * 1/1995 Hwang ..... A47C 1/143 297/380
5,388,293 A * 2/1995 Kistner ..... A47G 9/0253 297/229
5,403,066 A * 4/1995 Drum ..... B60N 2/6054 297/219.1
5,424,519 A * 6/1995 Salee ..... A61F 7/03 219/759
5,491,851 A * 2/1996 Alonso ..... A47C 27/001 5/420
5,584,422 A * 12/1996 Bond-Madsen ..... A47O 7/425 297/229 X
5,630,643 A * 5/1997 Scholten ..... A47C 3/12 297/218.2
5,639,145 A * 6/1997 Alderman ..... A47O 7/021 297/229 X
5,641,199 A * 6/1997 Bond-Madsen ..... A47O 7/021 297/229
5,642,917 A * 7/1997 Geiger ..... A47D 1/103 297/219.12
5,893,184 A * 4/1999 Murphy ..... A47O 7/024 297/229
5,988,744 A * 11/1999 Franchak ..... A47D 15/006 297/219.12
6,036,271 A * 3/2000 Wilkinson ..... A61G 5/1043 297/219.1
6,079,778 A * 6/2000 Lindberg ..... A47C 31/11 297/229 X
6,089,659 A * 7/2000 Toyota ..... A47C 31/11 297/229 X
6,155,647 A * 12/2000 Albecker, III ..... A47C 1/146 5/633 X
6,175,980 B1 * 1/2001 Gaither ..... A47C 7/021 5/654 X
6,244,481 B1 * 6/2001 Brougher ..... A45F 4/02 297/219.1 X
6,481,736 B1 * 11/2002 Chan ..... A61G 5/10 297/229 X
6,485,100 B1 * 11/2002 Hitt ..... A47C 7/18 297/219.1
6,582,017 B1 * 6/2003 Barnes ..... B62B 3/144 297/229 X
6,588,840 B1 * 7/2003 Lombardo ..... A47C 1/16 297/219.1 X
6,783,175 B1 * 8/2004 Henderson ..... A45F 4/06 297/219.1
6,848,746 B2 * 2/2005 Gentry ..... A47O 7/021 297/229 X
6,866,337 B1 * 3/2005 Lash ..... A47C 31/11 297/219.1 X
6,929,325 B1 * 8/2005 Goelo ..... A47O 1/16 297/229 X
6,988,771 B1 * 1/2006 Huang ..... A47C 31/00 297/219.1
7,114,776 B1 * 10/2006 Wiltberger ..... A47C 7/029 297/229 X
7,438,356 B2 * 10/2008 Howman ..... A47O 7/021 297/229 X
D591,996 S * 5/2009 Green ..... D6/601
7,614,691 B1 * 11/2009 Schmitz ..... A47O 7/021 297/229 X
D632,502 S * 2/2011 Gillespie ..... D6/335
8,147,000 B1 * 4/2012 Drake ..... A47C 7/0213 297/219.1 X
8,534,755 B2 * 9/2013 Nickerson ..... A45F 4/02 297/219.1
9,021,637 B1 * 5/2015 Whelan ..... A61G 5/1043 5/654
10,064,492 B2 * 9/2018 Lobel ..... A47C 7/021
2003/0097713 A1 * 5/2003 Kinchen ..... A47G 33/008 5/652
2003/0205920 A1 * 11/2003 Sprouse, II ..... A47C 7/021 297/219.1
2005/0189803 A1 * 9/2005 Kasten ..... A61G 5/1054 297/219.1
2008/0302840 A1 * 12/2008 Missick ..... A45F 4/02 297/219.1 X
2009/0218861 A1 * 9/2009 Conforti ..... A47C 31/126 297/223
2011/0127815 A1 * 6/2011 Nickerson ..... A47C 4/52 297/219.1 X
2011/0260512 A1 * 10/2011 Renda ..... A47C 31/11 297/219.1
2012/0193957 A1 * 8/2012 Grover ..... B60R 22/14 297/219.1
2013/0187415 A1 * 7/2013 Shelley ..... A47C 7/021 297/219.1 X
2013/0229036 A1 * 9/2013 Bill, III ..... B60N 2/26 297/188.2
2014/0223666 A1 * 8/2014 Pavlin ..... A61G 5/10 5/727
2015/0015038 A1 * 1/2015 Hampton ..... A47C 31/11 297/229
2015/0164228 A1 * 6/2015 Scorgie ..... A47O 13/00 297/229 X
2015/0238036 A1 * 8/2015 Robbins, III ..... A47C 7/18 297/219.1 X

* cited by examiner

LIFTING PAD FOR WHEELCHAIR

BACKGROUND OF THE INVENTION

1. Field of the Invention

The present invention relates generally to a cushion for seats, in particular to a lifting pad for a wheelchair that is used to keep a user in a proper sitting position and to provide more comfort to the user.

2. Description of the Related Art

Wheelchairs are maneuvered devices that are used when a user needs assistance in moving from place to place as they cannot simply move on their own due to an illness or injury. Wheelchairs come in a plurality of sizes, styles, and functional uses. That is, wheelchairs come in different sizes and configurations to accommodate various uses and people of different weight and height. A traditional wheelchair includes two side wheels each of which include a circular ring that is manually engaged by the user in order to propel the user and wheelchair as intended. Most wheelchairs further include a pair of handles that extend from behind the wheelchair such that someone other than the user can propel the wheelchair and the user. Wheelchairs' seats are not the most comfortable, as those are designed merely for utility and to be cost-effective. Individuals who are forced to spend extended time seated in wheelchairs are subject to constant pressure in their lower spine and surrounding regions, which may lead to tissue damage and other complications to such users.

There are some cushions and similar seating accessories known in the art that attempt to address these problems by reducing pressure on restricted areas of tissue. Applicant believes that a related application corresponds to US Patent Publication Number 20030205920A1 issued to Sprouse et al. which discloses a multi-layer cushion having a shaped base on which is positioned a resilient cushioning layer. The shaped base is constructed from a supportive foam and has front and lateral bolsters. The cushioning layer is an inflatable air cell cushion having a flexible base and an array of individual air cells arranged in rows across the flexible base. Rows of cells around the perimeter of the air cell cushion are configured to provide comfortable transition areas between the bolsters and the air cell cushion. The cushion includes a cover that has a lower compartment for the foam base and an upper compartment for the air cell layer. The cover functions to keep the air cell layer in place on the foam layer.

Other documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a lifting pad for a wheelchair for preventing excessive pressure on the base of a person's spine.

It is another objective of the present invention to provide a lifting pad in which relative movement between seat portion and backrest portion thereof is precluded.

It is yet another objective of the present invention to provide a lifting pad with simple construction and which is inexpensive to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
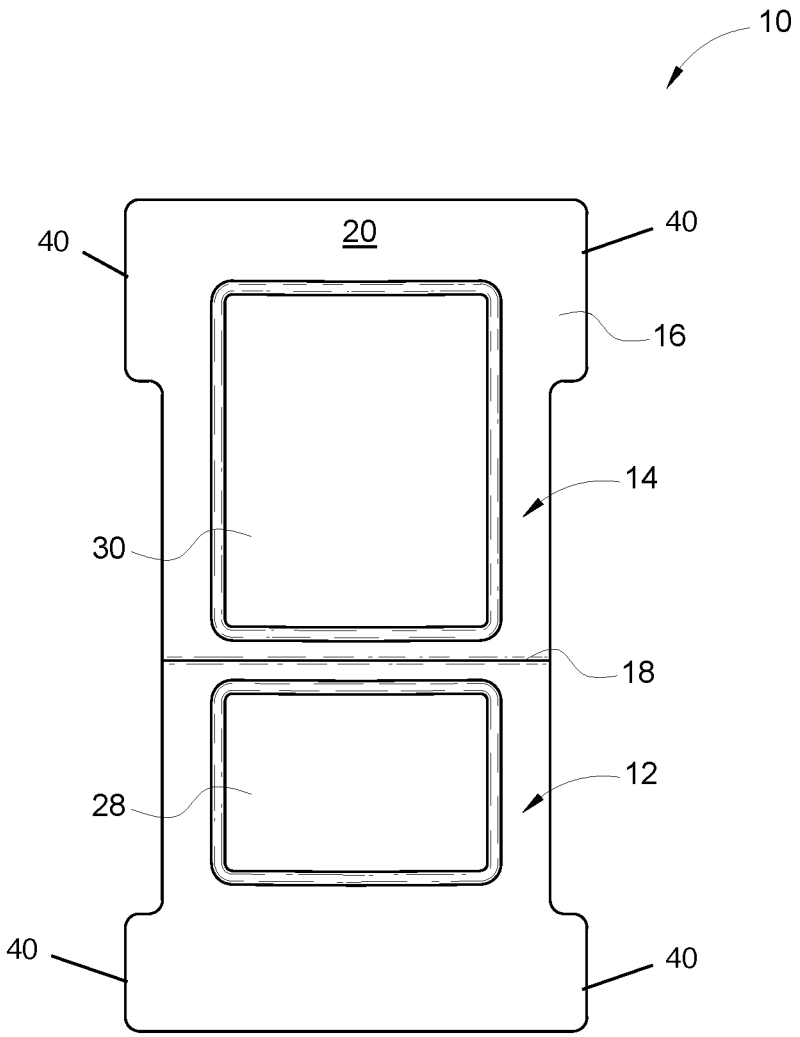
FIG. 1 illustrates a diagrammatic front planar view of a lifting pad 10, in accordance with one or more embodiments of the present invention.

Referring to the drawings, FIG. 1 illustrates a diagrammatic view of a lifting pad (generally designated by the numeral 10), in accordance with embodiments of the present disclosure. Lifting pad 10 of the present invention is designed to be implemented for possible use with a seat, such as a chair, a vehicle seat, a wheel chair and the like. Lifting pad 10 is particularly designed to be used with wheelchairs to provide comfort to the user and to prevent the user from sliding down into a slumped position. Thereby, lifting pad 10 may help to reduce the likelihood of decubitus ulcers in a patient in a wheelchair. It may be appreciated that general construction and design of the lifting pad 10 is similar to cushioning accessories as have been implemented with a seat or the like as known in the art and there may exist many variations related to size, shape and configurations for various specific purposes and implementations, all of which are incorporated herein without any limitations.

Figure 2:
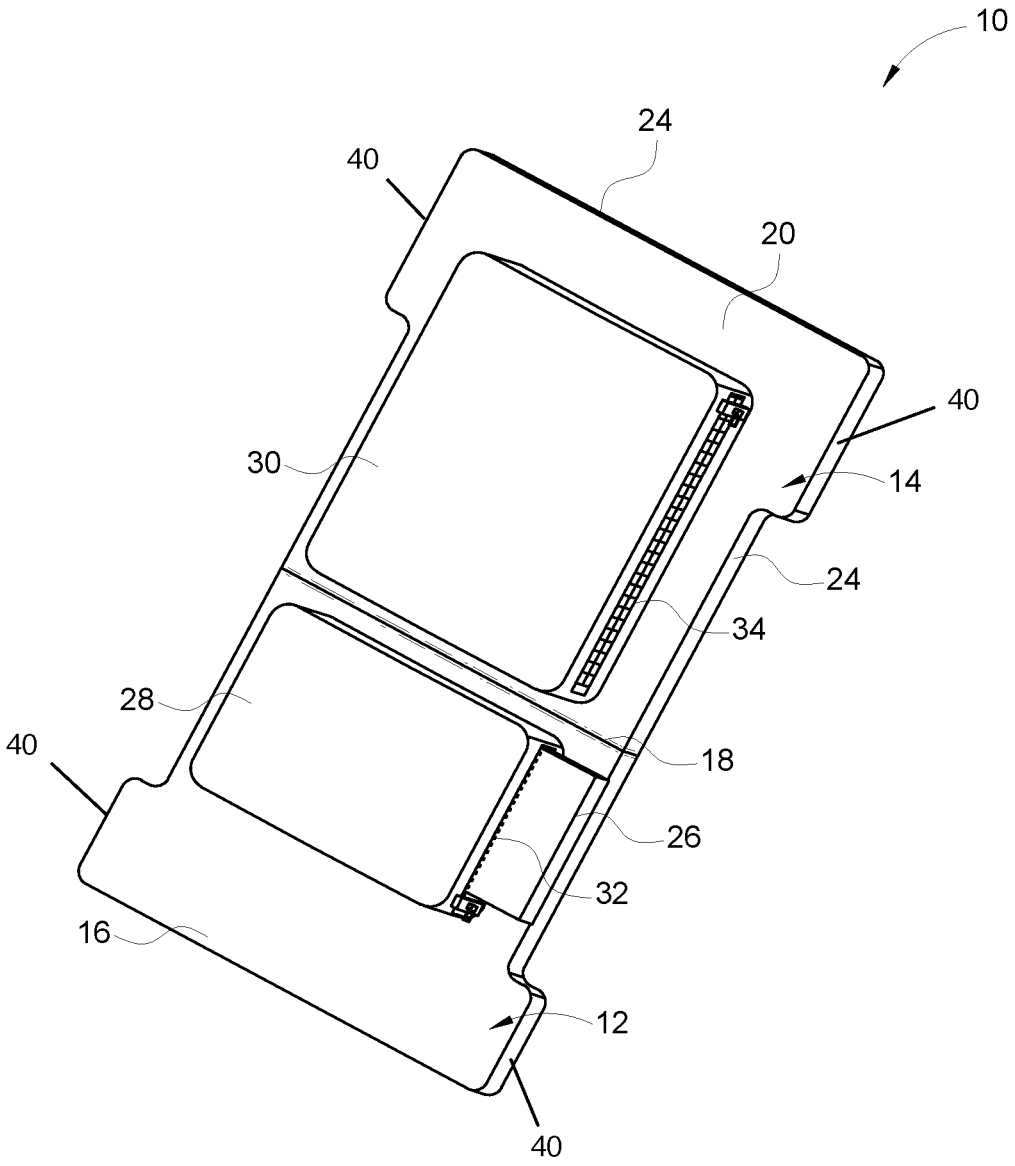
FIG. 2 illustrates isometric view of the lifting pad 10, in accordance with one or more embodiments of the present invention.

Referring now to FIGS. 1-2 in combination, as illustrated, lifting pad 10 includes a seat portion 12 and a backrest portion 14 which are attached to each other. Seat portion 12 and backrest portion 14 may be integrally formed with each other or may be permanently attached together by any suitable means without any limitations. Alternatively, in some examples, seat portion 12 and backrest portion 14 may be detachable from each other for customization and convenience without departing from the scope of the present invention. Lifting pad 10 includes a cover 16 or a sling like structure which may be extending over and between seat portion 12 and backrest portion 14. Depending on the configuration of seat portion 12 and backrest portion 14, cover 16 may be a continuous structure, or may be formed as two-pieces with one piece each for the seat portion 12 and the backrest portion 14. As illustrated, cover 16 may be creased at region 18 to allow for folding of lifting pad 10 to put seat portion 12 and backrest portion 14 at an angle, such as substantially orthogonal, with respect to each other as may be needed for a seating position.

Figure 3:
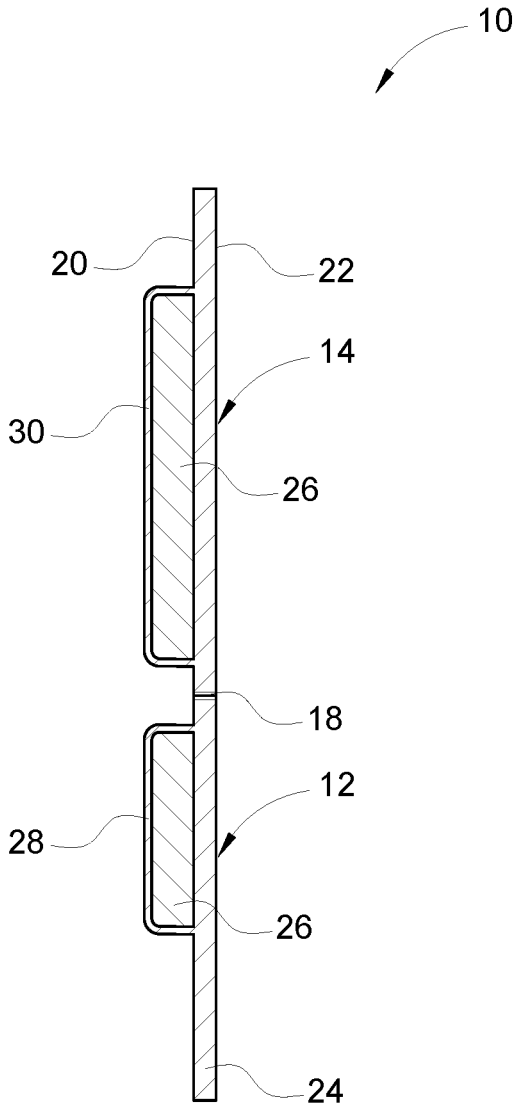
FIG. 3 illustrates a cross sectional view of the lifting pad 10, in accordance with one or more embodiments of the present invention.

As may be seen from FIGS. 1-3, cover 16 may include a top surface 20, a bottom surface 22 and side walls 24. In one or more examples, side walls 24 may be sewed to top surface 20 and bottom surface 22. In one or more embodiments, cover 16 may have a smooth or contoured surface and may be of any desired thickness, whether the surface is contoured or substantially planar. Cover 16, or at least portion of cover 16 in seat portion 12 and backrest portion 14 which comes in contact with the person sitting on lifting pad 10, may be made from moisture-absorbing fibrous material, such as natural or artificial polyester, such as those manufactured from short-length polyester fibers. For example, top surface 20 of cover 16 may be made of such material. Further, the rest portion of cover 16, which does not come in contact with the body of the user and which comes in contact with the surface, like a chair or wheelchair's seat upon which lifting pad 10 is placed, may be fabricated from any suitable textile material, preferably of material with relatively high frictional characteristics over leather or like material which are generally utilized for wheelchair seat covers or chair seat cushion covers, and the like. For example, bottom surface 22 of cover 16 may be made of such material. In some examples, bottom surface 22 of cover 16 may preferably be of corrugated type made from any suitable textile material such as cotton, wool, nylon, polyester, etc.

Further, as illustrated in FIGS. 2-3, lifting pad 10 includes foam inserts 26 enclosed therein. In particular, lifting pad 10 includes two foam inserts 26, with one foam insert 26 arranged in each of seat portion 12 and backrest portion 14. For this purpose, cover 16 includes slots formed therein, such that foam inserts 26 may be inserted into the slots. As better seen from FIG. 2, cover 16 includes a first slot 28 (shown opened with corresponding foam insert 26 shown half-way out) formed in seat portion 12 and a second slot 30 (shown closed). Cover 16 includes zipper arrangements 32 and 34 for first slot 28 and a second slot 30, respectively. Zipper arrangements 32 and 34 are used for disposing slots 28 and 30 between open and closed positions, in order to allow for insertion and removal of respective foam inserts 26 in their respective open positions and for firmly holding foam inserts 26 therein in their respective closed positions. Such arrangement may be contemplated by a person skilled in the art and have not been described herein further for the brevity of the present disclosure.

In the present examples, foam inserts 26 may be fabricated from polyurethane foam. Foam inserts 26 are of size sufficient to fill the respective slots 28 and 30 in cover 16. Foam inserts 26 are sized to ensure that the corners are filled with foam and that the foam fits flush in the corners to provide proper support throughout respective seat portion 12 and backrest portion 14. In one or more embodiments of the present disclosure, foam inserts 26 are gel based foam inserts which can easily conform to the shape of slots 28 and 30 in cover 16, and could provide proper cushioning support to a user sitting on a seat provided with lifting pad 10. It may be appreciated that foam inserts 26, as provided inside of cover 16, are large enough to relieve the pressure on the coccyx of a person utilizing lifting pad 10, but must not be too large so as to inadequately support the remaining bone structure within the buttocks.

In one or more embodiments of the present disclosure, lifting pad 10 may be provided with heat regulation means for seat portion 12 and backrest portion 14. For instance, a heat regulation device (not shown) may be provided in first slot 28 which may be used for heating and/or cooling of gel in corresponding foam insert 26, so as to provide comfort to the buttock portion of a user seated on seat portion 12. Similarly, a heat regulation device (not shown) may be provided in second slot 30 which may be used for heating and/or cooling of gel in corresponding foam insert 26, so as to provide comfort to the back portion of a user coining in contact with backrest portion 14. It may be contemplated by a person skilled in the art that any type of heat regulating device, such as a thermocouple, filament heater, cooling water flow means, or the like may be employed for such purpose. Further, it may be appreciated that such heat regulating device(s) may be powered by a portable rechargeable battery (not shown) integrated into the lifting pad 10.

Figure 4:
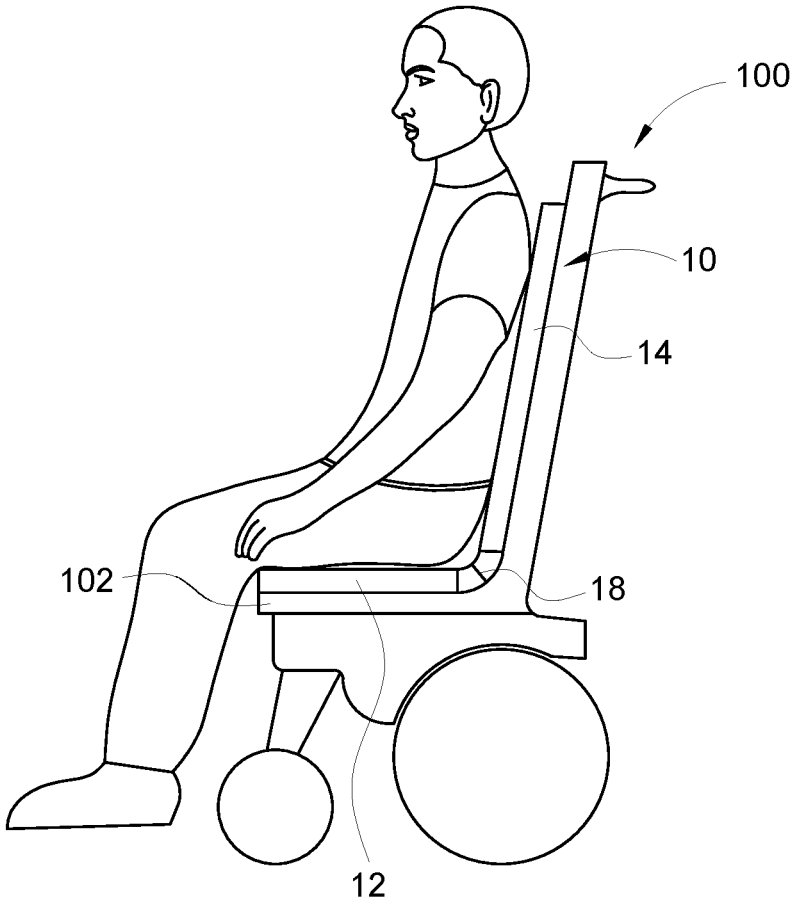
FIG. 4 illustrates a diagrammatic implementation of the lifting pad 10 with a wheelchair, in accordance with one or more embodiments of the present invention.

As seen from FIG. 4, lifting pad 10 of the present disclosure can be implemented with a wheelchair, such as wheelchair 100. In particular, lifting pad 10 is placed on a seat 102 of the wheelchair 100. Lifting pad 10 is placed such that seat portion 12 thereof supports lower buttock region of user and backrest portion 14 supports spine region of the user, seated on wheelchair 100. Herein, seat portion 12 is contoured to conform to a lower buttock portion of the user and backrest portion 14 is conformed to a spine region of the user. It may be appreciated that seat portion 12 and backrest portion 14, and thereby respective first slot 28 and second slot 30, are of different size to allow for general conformity and customization for human body shape. In an alternate embodiment, lifting pad 10 may further include tab-like extensions 40 attached with top and bottom side walls 24 of cover 16 to allow lifting pad 10 to be implemented as a sling-like structure, and thereby lifting pad 10 can be utilized as a folding seating device, as and when required. This may also be used to aid lifting pad to be attached to various types of wheelchairs and seats.

Lifting pad 10 of the present disclosure helps to prevent excessive pressure on the base of an individual's spine seated thereon. Lifting pad 10 can also help to preclude relative movement between seat portion 12 and backrest portion 14 thereof so as to prevent a user in a wheelchair from sliding down into a slumped position. This helps to reduce the likelihood of decubitus ulcers in a user in a wheelchair. Lifting pad 10 further helps to lift a user seated on a wheelchair generally up, as in many cases a person sitting on wheelchair's seat is slouched which may be uncomfortable and can also lead to many problems. Thus, lifting pad 10 of the present disclosure, in addition to providing comfort to the user, can also help to prevent tissue damage due to excessive pressure on certain regions of body of the individual due to extended seating and further helps to improve posture.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A lifting pad, comprising:

a cover with a seat portion and a backrest portion, wherein said seat portion and said backrest portion are in abutting engagement at a creased region, wherein said cover includes tab extensions along lateral sidewalls of said seat portion and said backrest portion, wherein said tab extensions are protruding portions of said seat portion and said backrest portion which extend outwardly from the lateral sidewalls, wherein said tab extensions are adapted to aid in the lifting and positioning of the cover on a wheelchair;

a first slot located on the seat portion and a second slot located on the backrest portion, wherein said first slot includes four sidewalls and a roof joined to form a first rectangular housing structure having a length and a width, wherein said first rectangular housing structure extends upwardly from a top surface of the seat portion of the cover, wherein said second slot includes four sidewalls and a roof joined to form a second rectangular housing structure having a length and a width, wherein the length of said first rectangular housing structure is less than the length of said second rectangular housing structure, wherein said second rectangular housing structure extends upwardly from a top surface of the backrest portion of the cover; and at least one foam insert arranged inside each of the first slot and the second slot in the cover, wherein the lifting pad is adapted to be placed on a seat to provide support to a user seated thereon.

2. The lifting pad of claim 1, wherein the first slot is provided with a zipper arrangement for opening and closing thereof, adapted to allow for insertion and removal of at least one foam insert therefrom.

3. The lifting pad of claim 1, wherein the second slot is provided with a zipper arrangement for opening and closing thereof, adapted to allow for insertion and removal of at least one foam insert therefrom.

4. The lifting pad of claim 1, wherein the cover has a top surface and a bottom surface, and wherein the top surface is formed of moisture absorbing material and the bottom surface is formed of high friction material.

5. The lifting pad of claim 4 wherein said moisture absorbing material is polyester manufactured from short-length polyester fibers.

6. The lifting pad of claim 1, wherein the seat portion is contoured to conform to a lower buttock portion of the user and the backrest portion is contoured to conform to a spine region of a user.

7. The lifting pad of claim 1, wherein the seat portion and backrest portion are of different sizes.

8. The lifting pad of claim 1 wherein said at least one foam insert is a gel-based foam insert.

9. A wheelchair lifting pad, consisting of:

a) a wheelchair with a seat and a backrest;

b) a cover with a seat portion and a backrest portion each having lateral sidewalls and a top surface formed of a moisture absorbing material and a bottom surface formed of a high friction material, wherein said cover includes tab extensions along said lateral sidewalls of said seat portion and said backrest portion, wherein said tab extensions are protruding portions of said seat portion and said backrest portion which extend from the lateral sidewalls, wherein said tab extensions are adapted to aid in the lifting and positioning of the cover on said wheelchair, wherein said seat portion is layered with said seat of said wheelchair and said backrest portion is layered with said backrest of said wheelchair, wherein said seat portion and said backrest portion are in abutting engagement at a creased region;

c) an upper pocket having four sidewalls and a roof which form a first rectangular housing structure with a length and a width located entirely on said backrest portion, wherein said first rectangular housing structure protrudes upwardly from said top surface of said backrest portion, said upper pocket having a first zipper arrangement aligned along one of the four sidewalls of the first rectangular structure that is adapted to provide access to an interior of said upper pocket;

d) a lower pocket having four sidewalls and a roof which form a second rectangular housing structure with a length and a width located entirely on said seat portion, wherein the length of the first rectangular housing structure is less than the length of the second rectangular housing structure, wherein said second rectangular housing structure protrudes upwardly from said top surface of said backrest portion, said upper pocket having a second zipper arrangement aligned along one of the four sidewalls of the second rectangular housing structure that is adapted to provide access to an interior of said lower pocket, wherein the first zipper arrangement and the second zipper arrangement are adjacently oriented;

e) a first gel-based foam insert that is positioned within said upper pocket adapted to relieve the pressure on a coccyx of a person, wherein said first gel-based insert conforms to said rectangular shape of said upper pocket; and f) a second gel-based foam insert that is positioned within said lower pocket adapted to relieve pressure on said coccyx of said person, wherein said first gel-based insert conforms to said rectangular shape of said lower pocket.

* * * * *